United States Patent [19]

Amster

[11] 4,249,731

[45] Feb. 10, 1981

[54] GAME RACKET

[76] Inventor: Harlan D. Amster, 2419 Brentwood Rd., Union, N.J. 07033

[21] Appl. No.: 846,674

[22] Filed: Oct. 31, 1977

[51] Int. Cl.[3] ..... A63B 51/02

[52] U.S. Cl. ..... 273/73 D

[58] Field of Search ..... 273/29 A, 73 R, 73 A, 273/73 C, 73 D, 73 E, 73 F, 73 H, 73 L, 76; 272/56.5 SS, 85; 46/43

[56] References Cited

U.S. PATENT DOCUMENTS

| | | | |
|---|---|---|---|
| 763,059 | 6/1904 | Hyde | 273/73 D |
| 1,132,214 | 3/1915 | Ries et al. | 273/73 D |
| 1,364,331 | 1/1921 | Vaile | 273/73 D |
| 1,531,778 | 3/1925 | Gallaudet | 273/73 D |
| 1,682,199 | 8/1928 | Smilie | 273/73 D |
| 2,028,663 | 1/1936 | Harroff | 273/73 A |
| 3,507,494 | 4/1970 | Finkel | 273/73 D X |
| 3,545,756 | 12/1970 | Nash | 273/73 D |
| 3,744,529 | 7/1973 | Jorda et al. | 273/73 D X |
| 3,820,785 | 6/1974 | Occhipinti et al. | 273/73 D X |
| 3,834,699 | 9/1974 | Pass | 273/73 D |
| 3,921,979 | 11/1975 | Dischinger | 273/73 D X |
| 3,926,431 | 12/1975 | DeLorean | 273/73 D |
| 3,941,188 | 3/1976 | Scheidl | 273/73 D X |
| 3,968,966 | 7/1976 | D'Aquanni | 273/73 D |
| 4,013,289 | 3/1977 | Kaminstein | 273/73 D |
| 4,026,553 | 5/1977 | Vendramini | 273/73 D X |
| 4,033,582 | 7/1977 | Linden | 273/73 D |
| 4,046,375 | 9/1977 | Lelong | 272/85 |

FOREIGN PATENT DOCUMENTS

| | | | |
|---|---|---|---|
| 1043897 | 11/1958 | Fed. Rep. of Germany | 273/73 D |
| 2143255 | 4/1973 | Fed. Rep. of Germany | 273/73 D |
| 2356972 | 5/1975 | Fed. Rep. of Germany | 273/73 D |
| 2405941 | 8/1975 | Fed. Rep. of Germany | 273/73 D |
| 2501659 | 7/1976 | Fed. Rep. of Germany | 273/73 D |
| 402899 | 9/1909 | France | 273/73 D |
| 267837 | 3/1927 | United Kingdom | 273/73 D |

OTHER PUBLICATIONS

"Hills' Court Inc."; Fall-Christmas 1976 Catalog; Sep. 1976; p.26.

*Primary Examiner*—Richard J. Apley

*Attorney, Agent, or Firm*—Lerner, David, Littenberg & Samuel

[57] ABSTRACT

An improved game racket is provided which includes a plurality of longitudinal and transverse strings disposed in parallel planes, and a unitary grid including a plurality of longitudinally-disposed first members disposed on a plurality of the longitudinal strings, and a plurality of transversely-disposed second members disposed on a plurality of the transverse strings so that the second members of the grid cross the first members thereof. The first and second grid members are bonded together at a plurality of crossing points so that the grid moves substantially as a unit with either the longitudinal or transverse strings of the grid when struck by a ball to increase the amount of top spin, back spin, or side spin imparted to the ball. In alternative embodiments, the grid includes either a plurality of longitudinally or transversely-disposed third members to provide an identical playing surface on either side of the racket. In addition, in the preferred embodiment, the grid members are provided with protuberances or roughened surfaces so as to increase the frictional engagement and the time span during which the grid members contact the ball to increase the spin imparted thereto. Also, the amount of spin imparted to the ball may be adjusted by varying the amount of tension on the longitudinal and transverse strings. Finally, the grid members may be in the form of elongated tubes or in the form of elongated guides or trackways.

2 Claims, 12 Drawing Figures

GAME RACKET

FIELD OF THE INVENTION

The present invention relates generally to game rackets, and specifically to improved tennis rackets which include a unitary grid disposed on the longitudinal and transverse strings of the racket, so that the grid and longitudinal or transverse strings move as a unit when struck by a ball to increase the amount of top spin, back spin, or side spin imparted to the ball when struck.

BACKGROUND OF THE INVENTION

In the past, there have been many attempts to improve tennis rackets and other similar string rackets. For example, some rackets have been developed in which the longitudinal and transverse strings are in separate planes, rather than being interwoven in the conventional manner. In addition, in some of the rackets in which the longitudinal and transverse strings are in separate planes, the strings are bonded together at their crossing points rather than being interwoven so as to provide a faster method of stringing rackets, as exemplified in U.S. Pat. No. 3,834,699. Also, in order to decrease wear on the strings of rackets, friction-reducing members have been placed between the strings at their crossing points, as may be seen in U.S. Pat. Nos. 1,682,199 and 3,921,979. In addition to improving the structure and durability of tennis rackets, attempts have also been made to modify conventional tennis rackets so as to improve a player's performance. For example, in order to impart extra spin to a ball, the strings in the central playing area of a racket have been secured together at their crossings, such as shown in U.S. Pat. No. 1,531,778. However, present racket designs, including the numerous modifications which have been made thereto, do not substantially increase the amount of spin which can be imparted to a ball during play.

Accordingly, it is an object of the present invention to provide an improved game racket which substantially increases the amount of top spin, back spin, or side spin imparted to a ball during play. Specifically, it is within the contemplation of the present invention to provide an improved game racket which employs a unitary grid construction which operates so that the grid and the longitudinal or transverse strings of the racket move as a unit when the grid is struck by a ball to increase the amount of spin imparted to the ball.

It is a further object of the present invention to provide a unitary grid for game rackets having protuberances or roughened surfaces formed thereon so as to increase the frictional engagement and increase the time span during which the grid members contact the ball to increase the amount of top spin, back spin, or side spin imparted thereto.

It is a still further object of the present invention to provide an improved game racket wherein the amount of top spin or side spin imparted to a ball may be adjusted by varying the amount of tension on the longitudinal or transverse strings of the racket.

SUMMARY OF THE INVENTION

Briefly, in accordance with the principles of the present invention, an improved game racket is provided which includes a plurality of longitudinal and transverse strings disposed in substantially parallel planes. A unitary grid is provided which, in one embodiment, includes a plurality of longitudinally-disposed first tubular members disposed on less than all of the longitudinal strings, and further includes a plurality of transversely-disposed second tubular members disposed on less than all of the transverse strings so that the second tubular members cross the first tubular members. The first and second tubular grid members are bonded together at a plurality of their crossing points so that the grid moves as a unit, and so that the grid and longitudinal or transverse strings which pass therethrough move as a unit when struck by a ball to substantially increase the amount of top spin, back spin, or side spin imparted to the ball.

In an alternative embodiment, the unitary grid further includes a plurality of longitudinally or transversely-disposed third tubular members so that the playing area of the racket includes an identical playing surface on either side thereof, and so that the grid and the longitudinal (or transverse) strings move as a unit and slide relative to the transverse (or longitudinal) strings.

In a preferred embodiment, the grid members are provided with protuberances or roughened surfaces so as to increase the frictional engagement and to increase the time span during which the grid members contact the ball to increase the amount of spin imparted thereto.

In the racket of the present invention, it is also preferable that the longitudinal strings have a tension which is below average, such as in the range of 15 to 40 psi, whereas the transverse strings have a tension higher than average, such as in the range of 50 to 80 psi. In this manner, the amount of top spin, back spin, or side spin imparted to the ball may be adjusted by varying the amounts of tension on the longitudinal and transverse strings, respectively.

In an alternative form of the invention, the grid members are in the form of guideways or trackways for guiding the movement of the strings as a unit. Moreover, in such an arrangement, the guideways or trackways themselves form the protuberances for increasing the frictional engagement between the grid members and ball.

In a preferred form of the invention, it is also desirable to interweave the longitudinal and transverse strings which do not pass through the grid members so as to hold the grid in its central position and to make the playing area sturdier.

BRIEF DESCRIPTION OF THE DRAWINGS

Further objects, features, and advantages of the present invention will become apparent upon the consideration of the following detailed description of a presently-preferred embodiment when taken in conjunction with the accompanying drawings, wherein.

DETAILED DISCUSSION OF PREFERRED EMBODIMENTS OF THE INVENTION

Figure 1:
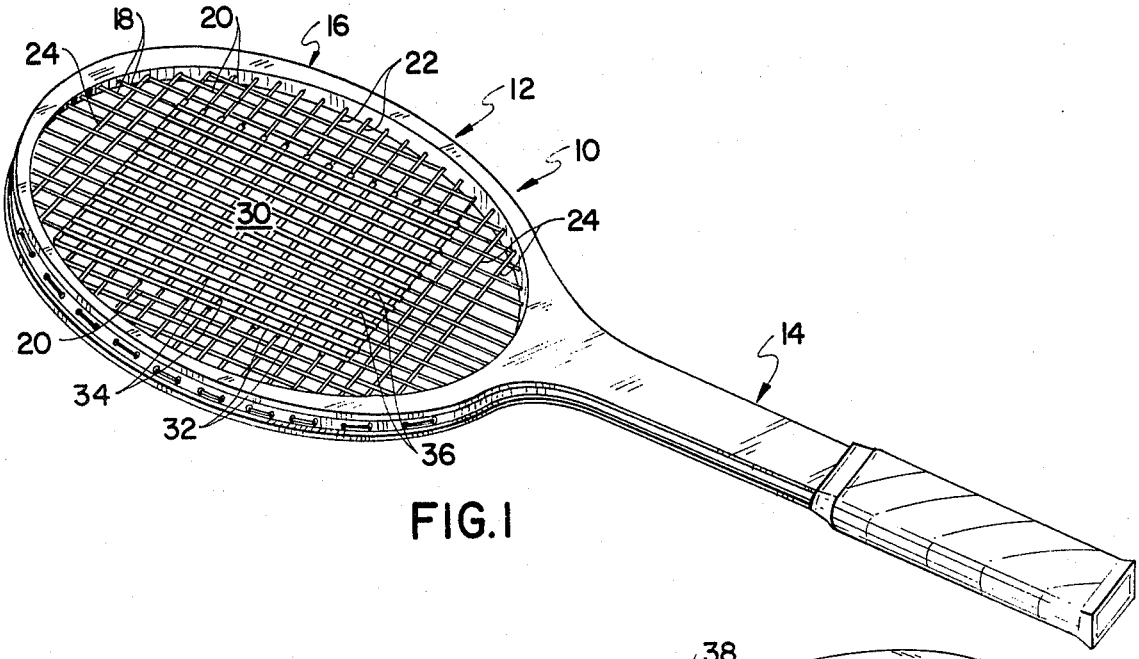
FIG. 1 is a perspective view of the game racket of the present invention in an intermediate stage having the grid members disposed on the strings of the racket.

Referring now to FIG. 1, there is shown an improved tennis racket embodying the present invention, generally designated by the reference numeral 10. The tennis racket includes a frame 12, of any suitable type, formed of any suitable material, such as wood, plastic, metal, fiberglass, or the like. the frame 12 includes a handle portion 14 and a playing head 16. The strings of the racket define a playing area which includes longitudinally-disposed strings 18 at the center of the playing area, and longitudinally-disposed strings 20 on either side of strings 18. As will be understood, longitudinally-disposed strings 18, 20 are connected to the frame 12 in any suitable manner.

The playing head 16 also includes a plurality of transversely-disposed strings 22 disposed at the center of the playing area, and transversely-disposed strings 24 on either side of strings 22. As will also be understood, transversely-disposed strings 22, 24 are connected to frame 12 in any suitable manner.

For reasons to be explained, the longitudinal strings 18 in the central playing area are disposed in one plane, and the transverse strings 22 in the central playing area are disposed in a second plane which is parallel to the first plane.

Figure 8:
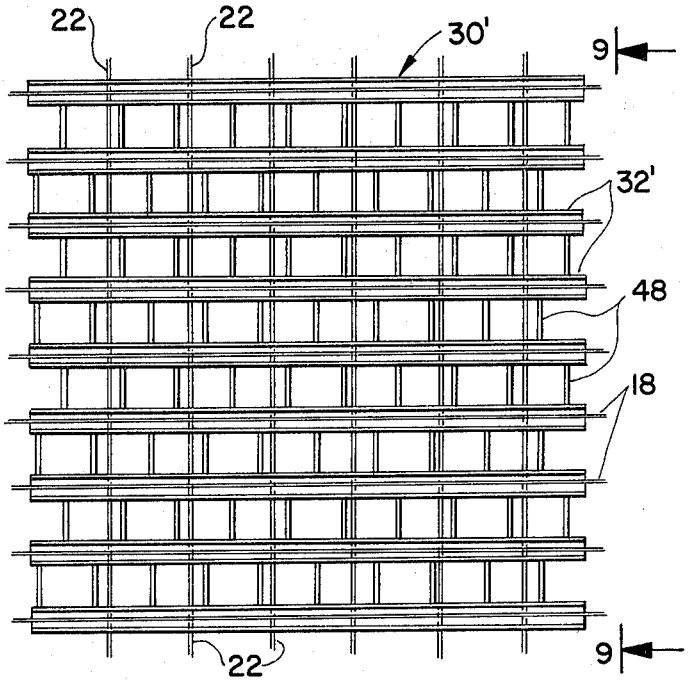
FIG. 8 is a top plan view of an alternative embodiment of a grid in accordance with the present invention wherein the grid members are all in the same plane.
Figure 10:
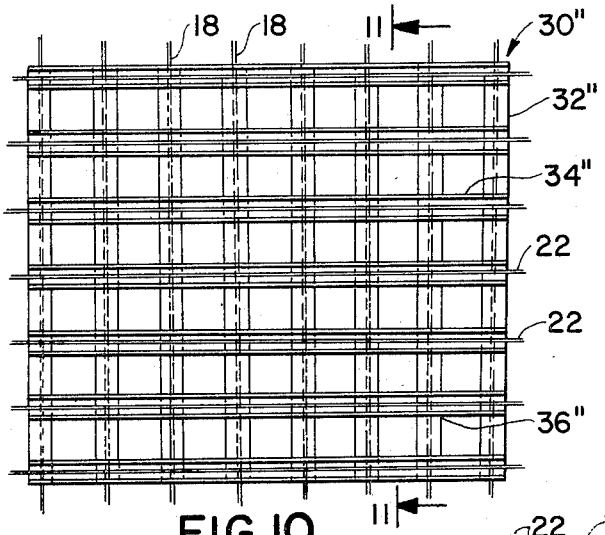
FIG. 10 is a top plan view illustrating in detail the structure of an alternative grid having trackways or guideways for both the longitudinal and transverse strings.

Still referring to FIG. 1, a grid 30 is shown disposed on the strings 18, 22 of the racket, the grid being in an intermediate stage of production. More particularly, grid 30 includes a plurality of longitudinally-disposed elongated tubular members 32 disposed on each of the longitudinal strings 18 in the central playing area. Grid 30 also includes a plurality of transversely-disposed elongated tubular members 34 disposed on each of the transverse strings 22 in the central playing area. As will be seen, elongated tubular members 32, 34 crisscross each other to define grid 30 and include a plurality of crossing points 36. Although shown as tubular members completely surrounding or substantially surrounding the strings of the racket, elongated tubular members 32, 34 do not have to completely surround and enclose the strings of the racket. The present invention envisions other possible configurations for grid members 32, 34 which will operate to perform the desired function and result, to be explained more fully herein. For example, as shown in FIGS. 8 and 10, grid members 32′ and 32″, 34″ may be in the form of trackways or guideways for guiding the movement of the longitudinal and transverse strings. Accordingly, as will be understood, the term "guides" or "guide members" in the claims is generic to and includes the aforementioned tubular members, trackways, and guideways, or U-shaped channel members, or any other structure for receiving and guiding the movement of the strings of the racket.

Figure 2:
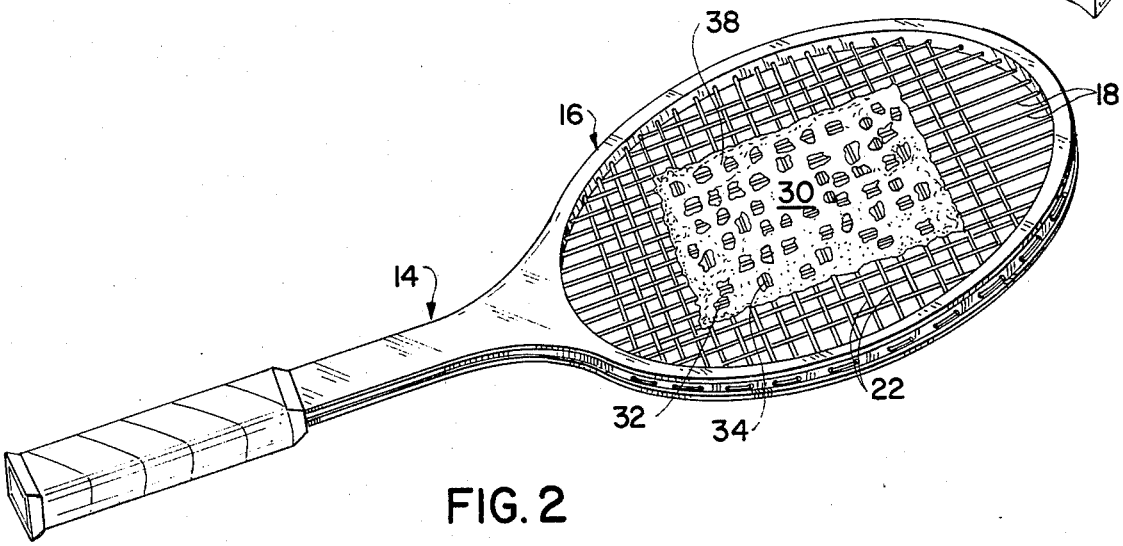
FIG. 2 is also a perspective view of the improved game racket of the present invention wherein the longitudinal and transverse grid members are bonded together.
Figure 6:
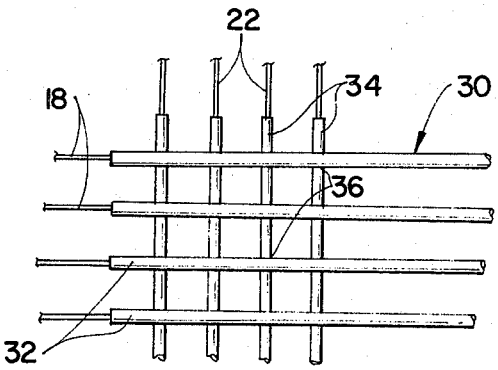
FIG. 6 is a plan view of a grid portion of a game racket wherein the longitudinal grid members are wider than the transverse grid members.
Figure 7:
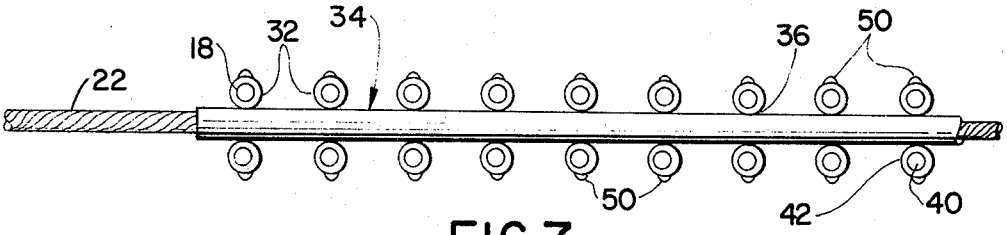
FIG. 7 is a cross-sectional veiw of an alternative embodiment of a unitary grid in accordance with the present invention wherein the grid includes three planes of grid members, with the outer most planes of grid members having protuberances formed thereon.

Once the strings of the racket are strung with the longitudinal and transverse strings 18, 22 in separate planes and with the grid members 32, 34 disposed on the strings 18, 22 in the central playing area thereof, grid members 32, 34 are then ready to be bonded together. Any suitable means may be employed to bond tubular members 32, 34 together at a plurality of their crossing points 36. For example, as shown in FIG. 2 of the drawings, a suitable adhesive or glue 38 is applied to the tubular members 32, 34 at their crossing points 36 so that when the tubular members 32, 34 are adhered to each other, the grid 30 moves substantially as a unit. It should also be understood that other means of adhering the grid members together are envisioned in the present invention. For example, it would be possible to merely weld the grid members together at a plurality of their crossing points 36, as shown in FIGS. 6 and 7. Alternatively, grid members 32, 34 may be injection-molded as a unitary grid, so that when the molded grid is removed from an injection mold, the longitudinal and transverse grid members 32, 34 (or 32′ or 32″, 34″) are already adhered to each other. Then, it would only be necessary to run the longitudinal and transverse strings through the respective grid members 32, 34 (or 32″,34″).

Figure 3:
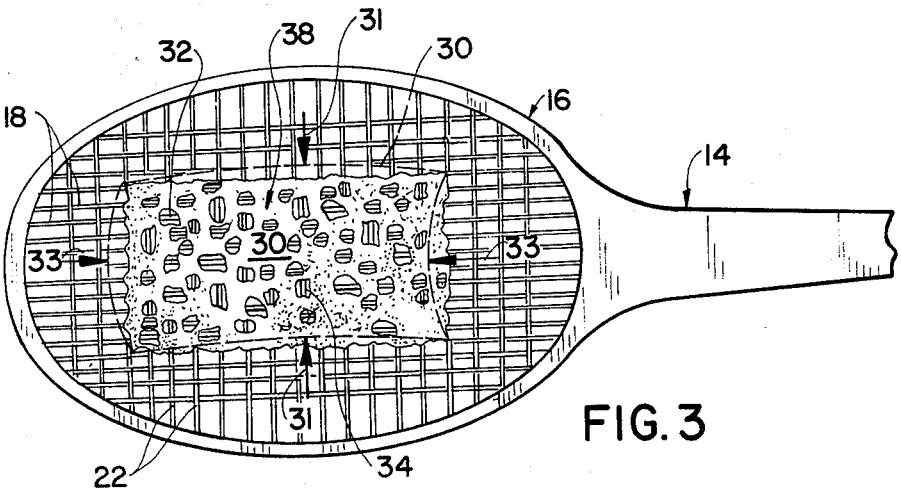
FIG. 3 is a top plan view illustrating the movement of the grid members and strings in longitudinal and transverse directions.

Turning now to FIG. 3, the action of the unitary grid 30 and the action of the strings of the racket when struck by a ball are illustrated. More particularly, in accordance with the principles of the present invention, unitary grid 30 will operate to substantially increase the amount of top spin, back spin, and side spin imparted to the ball during play. For example, in the usual forehand or backhand stroke, the racket of the present invention is moved up or down in the conventional way to impart the top spin or back spin to the ball. As a result, when the ball strikes unitary grid 30, and in particular longitudinally-disposed tubular members 32, the entire grid 30 and the longitudinal strings 18 extending through grid members 32 will move as a unit and slide relative to transverse strings 22. This transverse movement of the grid 30 and longitudinal strings 18 is illustrated in FIG. 3 by the dotted-line position of grid 30. Of course, it will be understood that grid 30 can move in either transverse direction, as illustrated by the arrows 31, depending on the player's movement of the racket being either up or down relative to the impact of the ball. As a result, the movement of grid 30 and longitudinal strings 18 in the transverse direction operates to substantially increase the amount of top spin or back spin imparted to the ball.

The improved racket of the present invention also operates to substantially increase the amount of side spin imparted to the ball when struck. More particularly, when the racket is moving in a longitudinal direction relative to the ball upon impact, the grid 30 of the present invention will operate to increase the amount of side spin imparted to the ball. In such a case, when the ball strikes unitary grid 30, and in particular, the longitudinal tubular members 32, the grid 30 and transverse strings 22 extending through tubular members 34 move as a unit and slide relative to the longitudinal strings 18. This longitudinal movement of the grid 30 and transverse strings 22 is illustrated by the dotted-line position of grid 30 in FIG. 3, and is represented by arrows 33. Of course, as will be understood, grid 30 may move in either longitudinal direction, designated by arrows 33, depending on the player's direction of movement of the racket. As a result of the longitudinal movement of grid 30 and transverse strings 22, an increased amount of side spin is imparted to the ball when struck by the player.

The above-described operation of the unitary grid 30 is based upon the ball being struck by the playing surface of the racket having the longitudinal tubular grid members 32. Of course, the backside of the game racket may be employed to strike the ball so that transverse grid members 34 will make actual contact with the ball. However, it should be understood that when the ball is struck by the backside of the game racket, the amount of spin imparted to the ball will be different than the amount of spin imparted to the ball when struck by the other side of the playing racket. More particularly, when the ball is engaged by transverse grid members 34, the amount of top spin or back spin imparted to the ball will be increased, but not to the same degree as when the ball is struck by longitudinal grid members 32. However, when the ball is struck by transverse grid members 34, the amount of side spin imparted to the ball will be increased to a greater extent than when the ball is struck by longitudinal grid members 32 on the other side of the game racket.

In addition, in order to further increase the amount of spin imparted to the ball, longitudinal strings 18 are provided with a different tension than transverse strings 22. More particularly, during the stringing operation, longitudinal strings 18 are provided with a tension which is lower than normal, approximately in the range of 15 to 40 pounds of pressure, whereas the transverse strings 22 are provided with a higher than normal tension, approximately in the range of 50 to 80 pounds of pressure. In this manner, longitudinal strings 18 are under less tension which allows more movement of the longitudinal strings relative to the transverse strings, and permits the limited degree of transverse movement of the longitudinal strings necessary to obtain the increased top spin or back spin effect. Such reduced tension also allows more movement of the transverse strings relative to the longitudinal strings to provide the increased side spin effect. Of course, the amount of top spin, back spin, or side spin which is imparted to the ball may be adjusted by changing the amount of tension, within the ranges specified, on the longitudinal or transverse strings of the racket.

At this point, an explanation will now be provided as to why the racket of the present invention operates to substantially increase the spin imparted to the ball, although it should be understood that this explanation is only a theory and that it sets forth no limitations on the present disclosure. More particularly, it is believed that the increased spin is obtained as a result of three different actions. First, as explained above, the movement of grid 30, in either the longitudinal or transverse direction, causes the playing surface of the racket to stay engaged with the ball for a slightly longer period of time which operates to increase the amount of spin imparted to the ball. Secondly, the glue or adhesive 38 on the grid 30, or any other such protuberance, provides rough surfaces and friction on the playing surface of the racket which causes the racket to stay engaged with the ball for a longer period of time and thereby increases the amount of spin imparted to the ball. Of course, it will be understood that any type of protuberance formed on the surfaces of the grid will impart such action to the ball and increase the amount of spin imparted. Thirdly, as explained above, the lower than normal tension on the longitudinal strings allows more movement of the longitudinal strings relative to the transverse strings (and vice versa), and permits the degree of transverse movement of the longitudinal strings which also operates to increase the top spin or back spin imparted to the ball. Similarly, the reduced tension on the longitudinal strings allows more movement of the transverse strings relative to the longitudinal strings and permits the degree of longitudinal movement of the transverse strings which operates to increase the side spin imparted to the ball.

Figure 4:
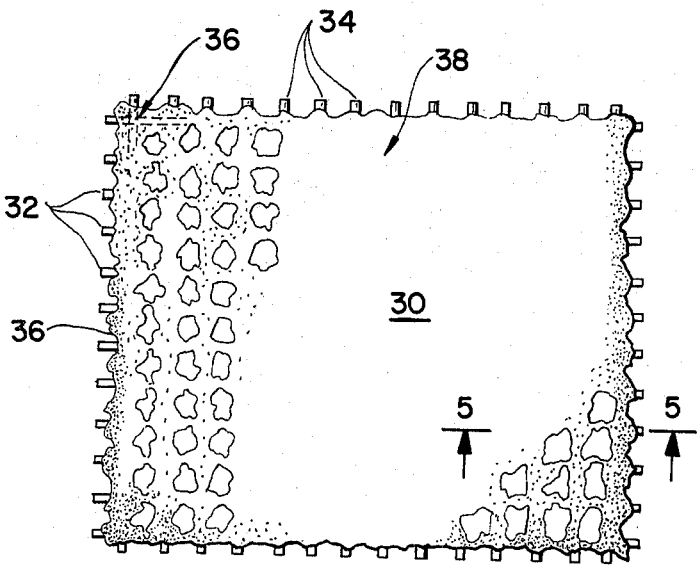
FIG. 4 is a plan view in detail of a unitary grid member in accordance with the present invention.

Turning now to FIG. 4, a detailed view of a completed grid 30 is shown, and as will be understood, grid 30 can be installed on a racket during the stringing operation. It will also be understood that such a grid can be made in a number of different ways. For example, elongated tubular members 32, 34 can be bonded or welded to each other at a plurality of their crossing points 36, instead of employing adhesive or glue 38. Additionally, it would also be possible to injection mold the grid 30 in one piece, so that upon removing grid 30 from the mold, it would only be necessary to run the longitudinal and transverse strings through the grid members. This would avoid the need for handling and assembling individual grid members 32, 34, and would also avoid the step of having to bond the grid members together. Of course, any of these methods of making the grid would be applicable, whether the grid members are tubes or trackways, as will be explained herein, or any other construction.

Turning now to FIG. 6, still another embodiment of the grid 30 of the present invention is illustrated. More particularly, it should be understood that grid members 32 may be of a different size than grid members 34. For example, since tubular members 32 define the preferred playing surface of the tennis racket which engages the ball, they are shown larger than tubular members 34. As a result of having tubular members 32 of a larger size, the top spin and back spin effect imparted to the ball would be further increased. Also, more control is obtained, and a larger hitting area is provided to the player.

Turning now to FIG. 7, a still further embodiment of the present invention is illustrated. More particularly, in some cases, it would also be desirable to provide an identical playing surface on each side of the tennis racket of the present invention so that either side of the strings may be employed as the playing surface. To accomplish this, a third plane of longitudinally-disposed strings 40 are provided and are connected to the frame 12 in any suitable manner. The grid 30 would further include a plurality of longitudinally-disposed, elongated tubular members 42 disposed on each of the longitudinal strings 40, so that the playing area of the racket includes an identical playing surface on either side thereof. Accordingly, when the ball engages either side of the playing area of the racket, the unitary grid including tubular members 32, 34, and 42 moves as a unit in a transverse direction to increase top spin or back spin, or in a longitudinal direction to increase side spin, in the manner explained above.

Although FIG. 7 illustrates an improved racket having three planes of grid members and three planes of strings, it is possible to construct improved game rackets having identical playing surfaces in other ways. For example, it is possible to delete the third plane of longitudinally-disposed strings 40 from the longitudinally-disposed tubular members 42 shown in FIG. 7. Even with the third plane of longitudinal strings deleted, the ball would still engage the same arrangement of grid members on either side of the racket, since longitudinal grid members 32 are identical to longitudinal grid members 42. As an alternative construction, it would also be possible to provide identical playing surfaces on each side of the tennis racket by employing a three-plane grid arrangement wherein the outermost grid members extend in a transverse direction, and the middle grid members extend in a longitudinal direction. Such a construction would be suitable for those players who desire a smaller increase in the amount of top spin or back spin, but a greater increase in the amount of side spin imparted to the ball when struck.

Figure 11:
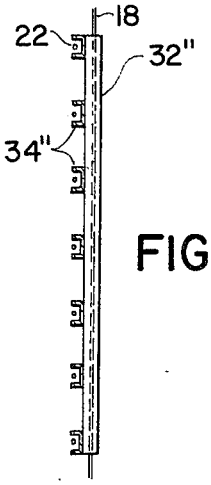
FIG. 11 is a cross-sectional view taken on line 11—11 of FIG. 10 illustrating the construction of the trackways of the grid.

As stated above, the present invention envisions other possible configurations for grid members 32, 34 which will operate to perform the desired function and result. For example, as shown most clearly in FIGS. 10 and 11, grid members 32″, 34″ may be in the form of U-shaped channels or trackways or guideways for guiding the movement of the longitudinal and transverse strings, respectively. More particularly, essentially U-shaped channel members may be employed as the longitudinally-disposed grid members 32″ to be disposed on each of the longitudinal strings 18. In addition, U-shaped channel members, facing in the opposite direction, may be employed as the transversely-disposed grid members 34″ to be disposed on each of the transverse strings 22 of the racket. As will be seen, the U-shaped channel members 32″, 34″ crisscross each other to define grid 30″ and include a plurality of crossing points 36″. As explained above, grid members 32″, 34″ may be bonded together at a plurality of their crossing points 36″ in any suitable manner so that the grid 30″ moves substantially as a unit. As will be understood, longitudinal strings 18 extend through longitudinal grid members 32″, and transverse strings 22 extend through transverse grid members 34″ in order to control their movement, in the same manner as explained above with respect to elongated tubular grid members 32, 34. Accordingly, grid 30″ and longitudinal strings 18 move as a unit and slide relative to transverse strings 22 when struck by a ball in one direction to increase the amount of top spin or back spin imparted to the ball, and grid 30″ and transverse strings 22 move as a unit and slide relative to longitudinal strings 18 when struck by a ball in a different direction to increase the amount of side spin imparted to the ball.

It will also be understood that the installation of unitary grid 30″ in a racket is relatively simple. Once the longitudinal and transverse strings are connected in different planes to the frame of the racket, it is then only necessary to slide the unitary grid 30″ between the two planes of strings so that the longitudinal strings 18 will be aligned within longitudinal grid members 32″, and so that transverse strings 22 will be aligned within transverse grid members 34″.

Figure 9:
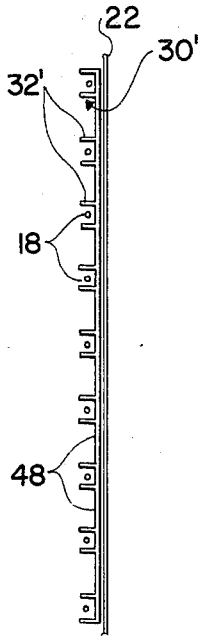
FIG. 9 is a cross-sectional view taken on line 9—9 of FIG. 8 illustrating the construction of the trackways of the grid.

The present invention also envisions the employment of grids in tennis rackets which will operate to substantially increase only top and back spin or only side spin, as compared to the above-described grids which operate to increase top spin, back spin, and side spin. More particularly, the present invention encompasses unitary grids having only one plane of either longitudinally or transversely-extending grid members. For example, as shown in FIGS. 8 and 9, grid 30′ includes longitudinally-disposed U-shaped channel members 32′ through which longitudinal strings 18 extend. The longitudinal grid members 32′ are connected to form an integral grid by transversely extending connecting members 48. In this manner, grid 30′ and longitudinal strings 18 move as a unit and slide on or relative to transverse strings 22 in a transverse direction when struck by a ball to increase the amount of top or back spin imparted to the ball. Alternatively, grid 30′ can be constructed from a plurality of transversely-extending U-shaped channel members 34′ (not shown) and be connected by a plurality of longitudinally-extending connecting members to form the unitary grid. In that case, the transverse strings 22 would move as a unit with the grid and slide on or relative to the longitudinal strings in a longitudinal direction when struck by a ball to increase the amount of side spin imparted to the ball.

Figure 12:
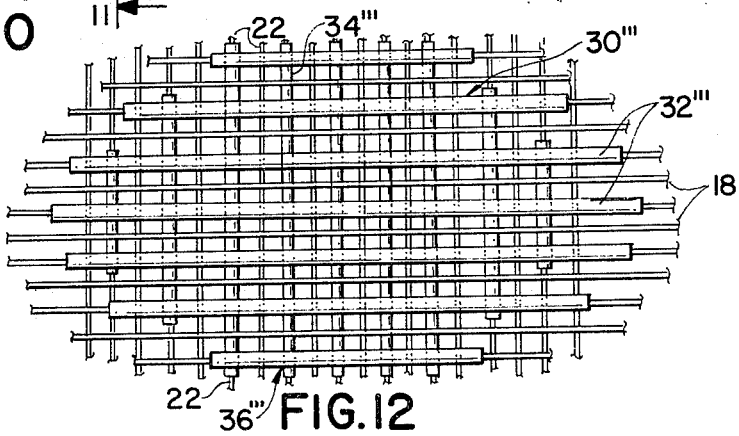
FIG. 12 is a top plan view of a portion of a game racket in accordance with the present invention wherein the outer periphery of the grid defines a substantially oval configuration.

Turning now to FIG. 12, there is shown a unitary grid 30‴, including longitudinal grid members 32‴ and transverse grid members 34‴ through which strings 18, 22 extend, respectively. As may be seen herein, the periphery of unitary grid 30‴ may have configurations other than the square or rectangular configurations shown in the foregoing embodiments. For example, as shown in FIG. 12, the outer periphery of the grid members 32‴, 34‴ may define a substantially oval configuration. Preferably, the oval configuration of the grid 30‴ would match the oval configuration of the playing head 16. In addition, as shown in FIG. 12, it is not necessary that the grid members be disposed on each of the longitudinal or transverse strings. For example, longitudinal grid members 32‴ may be disposed on alternate longitudinal strings 18, and transverse grid members 34‴ may be disposed on alternate transverse strings 22.

It is also within the scope of the present invention that the unitary grid be installed or employed in a game racket in such a manner that the unitary grid is maintained substantially in position at the center of the playing area of playing head 16. In order to accomplish this, one or more of the longitudinal and transverse strings between the periphery of the grid and the frame 12 may be interwoven in the conventional manner. For example, as shown in FIGS. 1 and 2, the longitudinal strings 20 on either side of the longitudinal strings 18 are interwoven with the transverse strings 22, 24. Similarly, the transverse strings 24 on either side of transverse strings 22 are interwoven with longitudinal strings 18 and 20. In this manner, the interwoven longitudinal and transverse strings surrounding the unitary grid operate to maintain the unitary grid in its central position of the playing area of the tennis racket.

Figure 5:
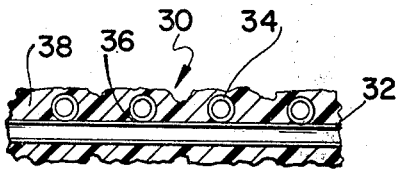
FIG. 5 is a cross-sectional view taken on line 5—5 of FIG. 4 illustrating the construction of the unitary grid.

As discussed above, it is preferable that the grid members be provided with rough surfaces or protuberances formed thereon so as to increase the frictional engagement and the time span during which the grid members contact the ball to increase the spin imparted thereto. As shown in FIGS. 4 and 5, such rough surfaces on the grid members may take the form of glue or adhesive 38, or as shown in FIG. 7, suitable protuberances 50 may be integrally formed with the grid members themselves, such as in a molding operation. In addition, as shown in FIGS. 8 and 10, the U-shaped channel members themselves form protuberances. Accordingly, as will be understood, the term "rough surfaces" in the claims is generic to and includes the aforementioned rough surfaces (FIG. 5), protuberances (FIG. 7), and U-shaped channel members (FIG. 9), or any other structure for increasing the frictional engagement when the grid members contact the ball to increase the spin imparted thereto.

It should also be noted that the tubing 32, 34 or trackways 32'', 34'' used to form the unitary grids of the present invention may be made from any suitable material, such as plastic, rubber, metal, or fiberglass. In addition, in order to increase or enhance the amount of relative movement between the grid members and the strings of the racket, it is also preferable to lubricate the inside of the tubular grid members or the U-shaped trackways so that the easier relative movement between the strings and the grid will operate to further increase the amount of spin imparted to the ball when struck.

In accordance with the present invention, the unitary grid construction has been shown as being at the center of the playing area of the racket with a space existing between the ends of the grid members and the frame of the racket. It will be noted that such space is necessary in order for the longitudinal and transverse grid members to be able to slide relative to the longitudinal and transverse strings without engaging and being impeded by the racket frame. Accordingly, it is within the scope of the present invention that the outer periphery of the grid members can extend as close to the frame as possible so long as there is sufficient space for the movement of the grid members relative to the strings of the racket. However, if it is desired to provide playing surfaces which are completely symmetrical so that the grid members extend all the way along the strings to the edge of the frame, this can be accomplished by providing the ends of the grid members with collapsible constructions. For example, the ends of each grid member can be provided with a sponge-like or resilient extension which will give when the grid is struck by a ball and will therefore allow the grid to move relative to the strings. With such sponge-like or resilient extensions on the ends of the grid members, as the unitary grid moves relative to the strings, the extensions will engage the edge of the frame of the racket and will be slightly compressed to permit the movement of the unitary grid relative to the strings.

In view of the foregoing, it will be appreciated that there has been provided in accordance with the present invention an improved construction for a game racket which substantially increases the amount of top spin, back spin, or side spin which may be imparted to a ball during play. The unitary grid construction of the present invention also provides other benefits. For example, since the grid members engage the ball directly, the grid reduces or substantially eliminates the amount of wear on the strings of the racket, and thereby substantially increases the life of the strings of the racket. In addition, as the strings of the racket are held in place and their spacing maintained by the grid members, the unitary grid construction operates to prevent the strings from spreading apart upon impact so that the ball is always hit uniformly by the strings.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A game racket, comprising:

a frame including a handle, a plurality of longitudinally-disposed strings connected to said frame and disposed in a first plane, a plurality of transversely-disposed strings connected to said frame and disposed in a second plane to define a playing area, said second plane being substantially parallel to said first plane in at least the central area of said frame, and a grid in said central area including a plurality of longitudinally-disposed first members each slidably disposed on separate ones of less than all of said plurality of longitudinally-disposed strings, said grid further including a plurality of transversely-disposed second members each slidably disposed on separate ones of less than all of said plurality of transversely-disposed strings so that said second members cross said first members, said first and second grid members being connected at a plurality of crossing points so that said grid moves substantially as a unit, and so that said grid and said less than all of said plurality of longitudinally-disposed strings move as a unit and slide relative to said transversely-disposed strings when struck by a ball in one direction to increase the amount of top spin or back spin imparted to said ball, and so that said grid and said less than all of said plurality of transversely-disposed strings move as a unit and slide relative to said longitudinally-disposed strings when struck by a ball in another direction to increase the amount of side spin imparted to said ball, and wherein the space between said grid and said frame includes transversely-disposed strings interwoven with said longitudinally-disposed strings.

2. A game racket in accordance with claim 1 wherein the space between said grid and said frame includes transversely-disposed strings interwoven with said longitudinally-disposed strings on all sides of said grid.

* * * * *